US008033887B2

(12) United States Patent
Yang et al.

(10) Patent No.: US 8,033,887 B2
(45) Date of Patent: Oct. 11, 2011

(54) METHOD FOR MANUFACTURING FIELD EMITTER

(75) Inventors: Yuan-Chao Yang, Beijing (CN); Liang Liu, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 556 days.

(21) Appl. No.: 11/588,086

(22) Filed: Oct. 26, 2006

(65) Prior Publication Data

US 2008/0009216 A1 Jan. 10, 2008

(30) Foreign Application Priority Data

Jul. 7, 2006 (CN) ..... 2006 1 0061558

(51) Int. Cl.
*H01J 9/04* (2006.01)
*H01J 9/12* (2006.01)

(52) U.S. Cl. ..... 445/50; 445/24; 445/25; 423/447.1; 423/447.3

(58) Field of Classification Search ..... 445/24–25, 445/50; 313/494–512; 423/447.1, 447.3
See application file for complete search history.

(56) References Cited

U.S. PATENT DOCUMENTS

| | | | | |
|---|---|---|---|---|
| 6,283,812 | B1 * | 9/2001 | Jin et al. | 445/24 |
| 6,383,923 | B1 * | 5/2002 | Brown et al. | 438/666 |
| 6,452,171 | B1 * | 9/2002 | Moloni | 850/57 |
| 6,749,827 | B2 * | 6/2004 | Smalley et al. | 423/447.3 |
| 7,045,108 | B2 | 5/2006 | Jiang et al. | |
| 2004/0047038 | A1 * | 3/2004 | Jiang et al. | 359/486 |
| 2004/0051432 | A1 * | 3/2004 | Jiang et al. | 313/311 |
| 2004/0053432 | A1 * | 3/2004 | Liu et al. | 438/40 |
| 2004/0095050 | A1 * | 5/2004 | Liu et al. | 313/309 |

* cited by examiner

*Primary Examiner* — Karabi Guharay
*Assistant Examiner* — Elmito Breval
(74) *Attorney, Agent, or Firm* — Altis Law Group, Inc.

(57) ABSTRACT

A method for manufacturing a field emitter, includes the steps of: providing a CNT yarn segment; attaching the CNT yarn segment to a heat conductor; and burning the CNT yarn segment thereby yielding a remaining portion of the CNT yarn segment for use as a field emitter. It is proper to manufacture a plurality of field emitters with essentially even field emission properties using the present method.

11 Claims, 4 Drawing Sheets

METHOD FOR MANUFACTURING FIELD EMITTER

TECHNICAL FIELD

The present invention generally relates to a method for manufacturing field emitters, which can achieve essentially even field emission.

BACKGROUND

Since being discovered in 1991, CNTs have been synthesized by numerous methods such as laser vaporization, arc discharge, pyrolysis, plasma-enhanced chemical vapor deposition, and thermal chemical vapor deposition. CNT yarns can be made of CNTs as disclosed in U.S. Pat. No. 7,045,108 incorporated by reference thereto. The CNT yarns would enable macroscopic CNT devices and structures to be constructed.

CNT yarns can be also be utilized as field emission source because ends of CNT yarns have a good field emission property. However, different CNT yarns may have different field emission properties depending on differing CNT yarn end shapes. Different CNT yarns usually have quite different CNT yarn end shapes. Moreover, CNT yarn length is difficult to control. Therefore, production of multiple CNT yarns with similar field emission properties has proved problematic.

It is therefore desirable to find a new manufacturing method which can overcome the above mentioned problems.

SUMMARY

In a preferred embodiment, a method for manufacturing a field emitter, includes the steps of: providing a CNT yarn segment; attaching the CNT yarn segment to a heat conductor; and burning the CNT yarn segment thereby yielding a remaining portion of the CNT yarn segment for use as a field emitter.

BRIEF DESCRIPTION OF THE DRAWINGS

Many aspects of embodiments can be better understood with reference to the following drawings. The components in the drawings are not necessarily drawn to scale, the emphasis instead being placed upon clearly illustrating the principles of the present embodiment. Moreover, in the drawings, like reference numerals designate corresponding parts throughout the several views.

DETAILED DESCRIPTION OF THE EMBODIMENTS

Embodiments will now be described in detail below with reference to the drawings.

A method for manufacturing a field emitter includes the steps of:

1) providing a CNT yarn;
2) dividing the CNT yarn into several CNT yarn segments;
3) attaching a CNT yarn segment to a heat conductor; and
4) burning the CNT yarn segment thereby yielding a remaining portion of the CNT yarn segment for use as a field emitter.

Figure 7:
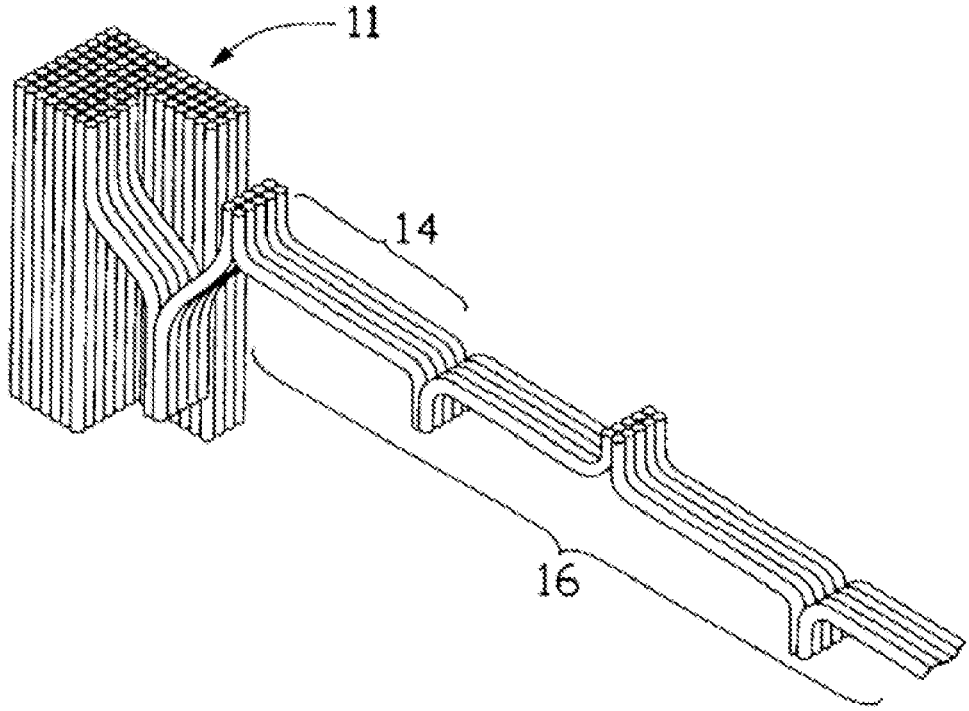
FIG. 7 is a schematic view of a method for drawing a CNT yarn.

In step 1, the CNT yam can be fabricated using a method, as disclosed in U.S. Pat. No. 7,045,108 which is incorporated herein by reference. The method includes the steps of: providing a flat and smooth substrate; depositing a catalyst on the substrate; positioning the substrate with the catalyst in a furnace; heating the furnace to a predetermined temperature; supplying a mixture of carbon containing gas and protecting gas into the furnace; maintaining a difference between the local temperature of the catalyst and the furnace temperature of above 50 degrees Centigrade (°C.); maintaining the partial pressure of the carbon containing gas at less than 0.2; growing a number of CNTs on the substrate such that a CNT array is formed on the substrate; and drawing out a bundle of CNTs 14 from the CNT array 11 in a manner such that a CNT yarn 16 is formed as shown in FIG. 7. The CNT yarn 16 includes a plurality of CNT bundles 14 joined end to end by van der Waals attractive force and each of the CNT bundles 14 comprising a plurality of CNTs substantially parallel to each other.

In step 2, the CNT yarn can be divided using a mechanical method, or a non-mechanical method. Mechanical methods can include cutting using a pair of scissors or a knife. Non-mechanical methods can include cutting using a laser, or burning. There is no particular limitation on a length of each CNT yarn segment. Since the CNT yarn segment is divided from the CNT yarn, each CNT yarn segment can also include a plurality of CNT bundles joined end to end by van der Waals attractive force and each of the CNT bundles comprising a plurality of CNTs substantially parallel to each other.

In step 3, the CNT yarn segment can be attached to the heat conductor using, for example, epoxy glue. The heat conductor is used as supporter and can be made of metal with a high heat conductivity and enough strength. The heat conductor can be, for example, a copper wire, or a copper stick. In the present embodiment, the heat conductor is a copper wire.

In step 4, the CNT segment is burned using a flame, for example, the flame of an alcohol lamp. The CNT segment can thus be burned evenly. A temperature of the flame can be in a range from 400° C. to 500° C. In this case, one part of the CNT yarn segment far away from the copper wire is burned down, but another part of the CNT yarn segment close to the copper wire is left due to a high heat conductivity of the CNT yarn segment. A length of a remainder portion of the CNT yarn segment after burning (hereinafter, refer to as the remainder portion) depends on following factors: oxidative atmosphere, temperature of flame, diameter of CNT yarn, material of the wire, and diameter of the wire.

In one embodiment, the length of the remainder portion and the factors are shown as follows:

| oxidative atmosphere | temperature of flame (° C.) | diameter of CNT yarn (microns) | material of the wire | diameter of the wire (microns) | length of the remainder portion (microns) |
|---|---|---|---|---|---|
| air | about 450 | about 50 | copper | about 600 | about 500 |

A plurality of field emitter can be obtained by repeating steps 3 and 4 consequently using CNT yarn segment in step 2. In step 3, it should be noted that each CNT yarn segment can be attached to a same heat conductor sequently, or attached to a plurality of roughly similar heat conductors respectively. In step 3, it should also be noted that the CNT yarn segments can be attached together to a heat conductor simultaneously. In this case, the CNT segments can be arranged evenly on the heat conductor.

Figure 1:
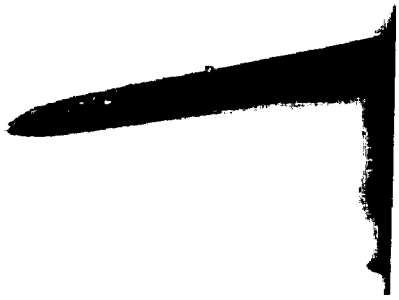
FIG. 1 is a scanning electron microscope (SEM) image of a first field emitter manufactured by the present method.
Figure 2:
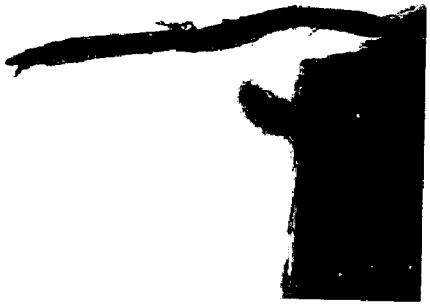
FIG. 2 is an SEM image of a second field emitter manufactured by the present method.
Figure 3:
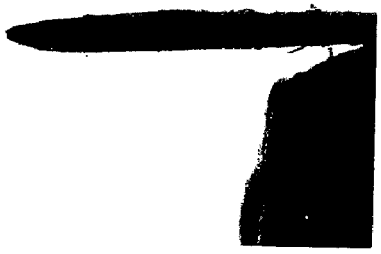
FIG. 3 is an SEM image of a third field emitter manufactured by the present method.
Figure 4:
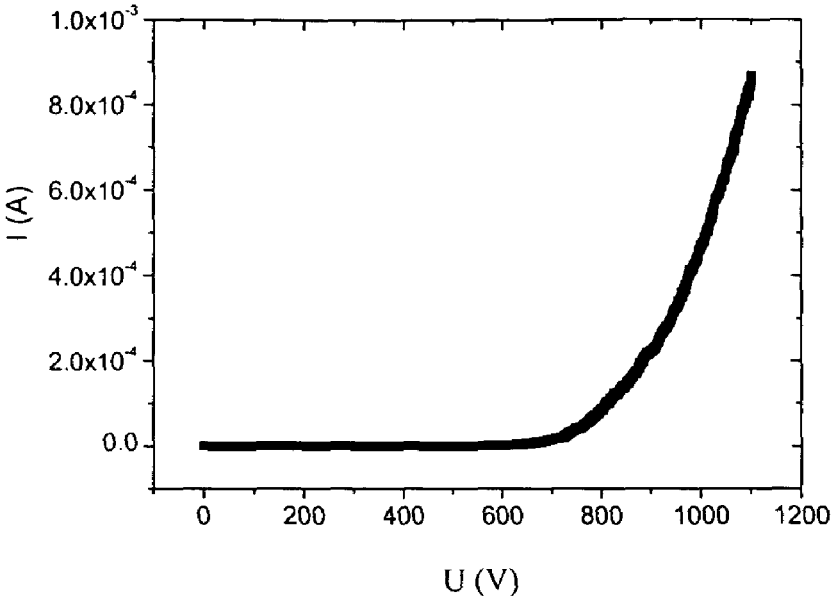
FIG. 4 is a field emission curve of the first field emitter of FIG. 1.
Figure 5:
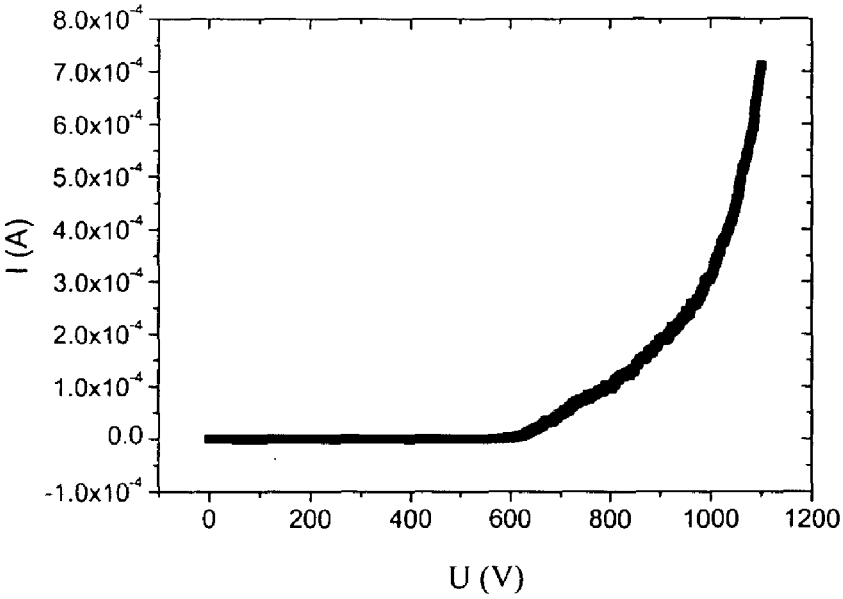
FIG. 5 is a field emission curve of the second field emitter of FIG. 2.
Figure 6:
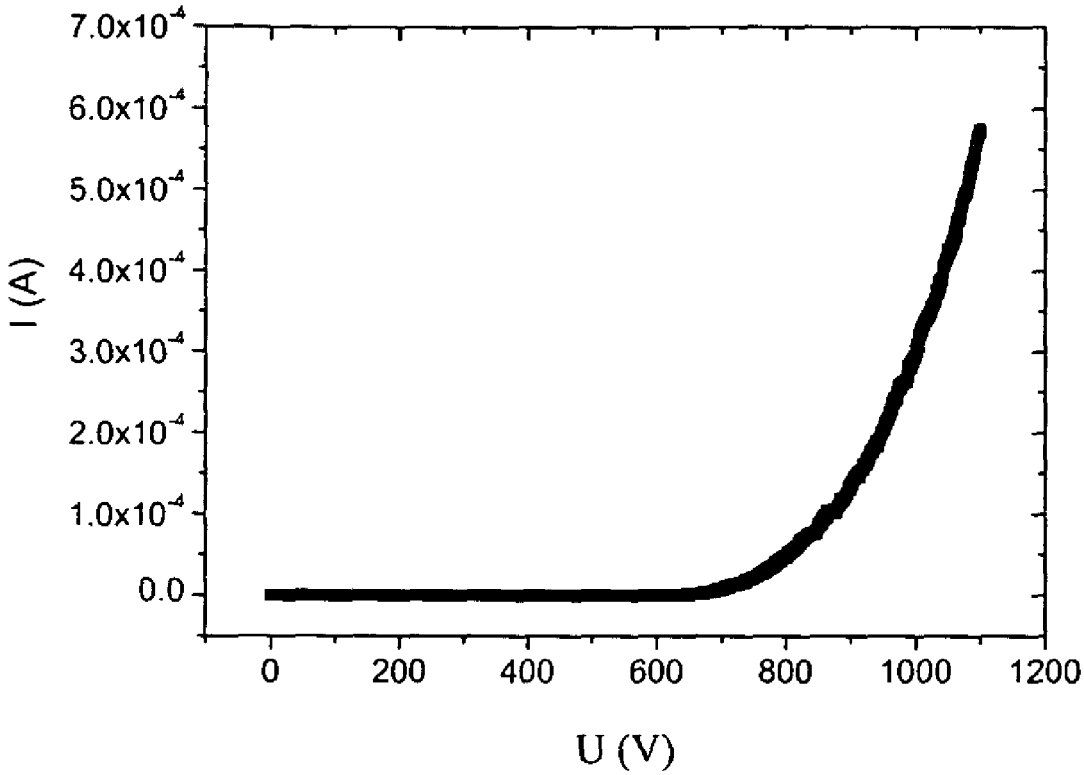
FIG. 6 is a field emission curve of the third field emitter of FIG. 3.

The three field emitters have a roughly same length and similar end-shape as seen in scanning electron microscope (SEM) pictures shown in FIGS. 1 to 3. Field emission curves of each field emitter are shown in FIGS. 4 to 6. In the curves, horizontal axes represent voltage (symbol U) in volts (V), and vertical axes represent current (symbol I) in amps (A). The three field emitters achieve a roughly same field emission property as seen from the charts.

It is therefore practical to manufacture a plurality of field emitters with substantially even field emission properties using the present method.

While certain embodiments have been described and exemplified above, various other embodiments will be apparent to those skilled in the art from the foregoing disclosure. The present invention is not limited to the particular embodiments described and exemplified but is capable of considerable variation and modification without departure from the scope of the appended claims.

What is claimed is:

1. A method for manufacturing a field emitter, comprising the steps of:

providing a CNT yarn;

dividing the CNT yarn, thereby yielding a CNT yarn segment, the CNT yarn segment comprising a plurality of CNT bundles joined end to end by van der Waals attractive force and each of the CNT bundles comprising a plurality of CNTs substantially parallel to each other;

attaching the CNT yarn segment to a metal conductor; and burning the CNT yarn segment using a flame, thereby yielding a remainder portion of the CNT yarn segment, the remainder portion of the CNT yarn segment being configured for use as a field emitter.

2. The method of claim 1, wherein the CNT yarn is obtained by a method comprising the steps of:

providing a CNT array; and drawing out a bundle of CNTs from the CNT array in a manner such that the CNT yarn is formed.

3. The method of claim 1, wherein the CNT yarn segment is cut from the CNT yarn using a tool selected from the group consisting of a knife and scissors.

4. The method of claim 1, wherein the CNT yarn segment is cut from the CNT yarn using a method selected from the group consisting of laser cutting and burning.

5. A method for manufacturing a field emitter, comprising the steps of:

providing a CNT yarn segment;

attaching the CNT yarn segment to a metal wire; and burning the CNT yarn segment using a flame, thereby yielding a remainder portion of the CNT yarn segment, the remainder portion of the CNT yarn segment being configured for use as a field emitter, wherein a length of the remainder portion of the CNT yarn segment after burning depends on the following factors: a presence of an oxidative atmosphere for burning, a temperature of the flame, a diameter of the CNT yarn segment, a material of the metal wire, and a diameter of the metal wire; and the length of the remainder portion of the CNT yarn segment after burning is controlled by fixing at least one of the factors above and changing at least one other of the factors above.

6. The method of claim 5, wherein the CNT yarn segment is burned in air.

7. The method of claim 5, wherein the temperature of the flame is in a range from about 400° C. to about 500° C.

8. The method of claim 5, wherein the diameter of the CNT yarn segment is about 50 microns.

9. The method of claim 5, wherein the material of the metal wire is copper.

10. The method of claim 5, wherein the diameter of the metal wire is about 600 microns.

11. A method for manufacturing a field emitter, comprising the steps of:

providing a CNT yarn segment comprising a plurality of CNT bundles joined end to end and each of the CNT bundles comprising a plurality of CNTs substantially parallel to each other;

attaching the CNT yarn segment to a metal conductor; and burning the CNT yarn segment using a flame, thereby yielding a remainder portion of the CNT yarn segment, the remainder portion of the CNT yarn segment being configured for use as a field emitter, wherein the field emitter has a CNT bundle tip, the CNT bundle tip being away from the metal conductor, a diameter of the CNT bundle tip being decreased along a direction away from the metal conductor.

* * * * *